United States Patent [19]

Fischer

[11] 4,252,272

[45] Feb. 24, 1981

[54] ELECTRICAL CONNECTING ELEMENT FOR A TOY RAILROAD

[76] Inventor: Artur Fischer, Weinhalde 34, D-7244 Waldachtal 3/Tumlingen, Fed. Rep. of Germany

[21] Appl. No.: 80,019

[22] Filed: Sep. 28, 1979

[30] Foreign Application Priority Data

Oct. 5, 1978 [DE] Fed. Rep. of Germany ..... 2843429

[51] Int. Cl.[3] ..... A63H 19/30

[52] U.S. Cl. ..... 238/10 E; 238/14.05; 339/21 R

[58] Field of Search ..... 238/14.05, 14.4, 10 E; 339/21 R, 21 S; 104/148 R

[56] References Cited

U.S. PATENT DOCUMENTS

| | | | |
|---|---|---|---|
| 1,779,605 | 10/1930 | Koerber | 238/10 E |
| 1,983,776 | 12/1934 | Rosenthal | 238/10 E |
| 2,036,312 | 4/1936 | Ziesenheim | 238/10 E |
| 2,040,665 | 5/1936 | McKeige | 238/10 E |

*Primary Examiner*—Richard A. Bertsch
*Attorney, Agent, or Firm*—Michael J. Striker

[57] ABSTRACT

An electrical connecting element for a toy railroad has a support member insertable between two adjacent ties which support rails and two contact members which are guided laterally outwardly of a track formed by the rails and rest against outer faces of the latter. One of the contact members is arranged above the support member, whereas the other contact member is arranged below the same.

6 Claims, 2 Drawing Figures

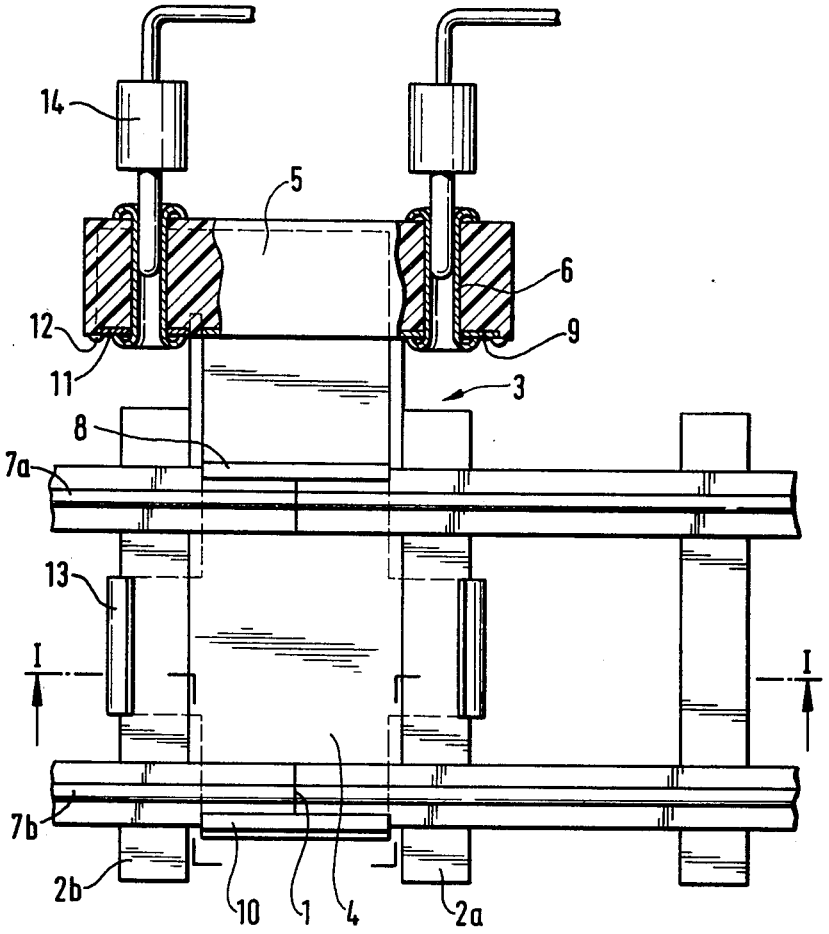
FIG.1
FIG.2
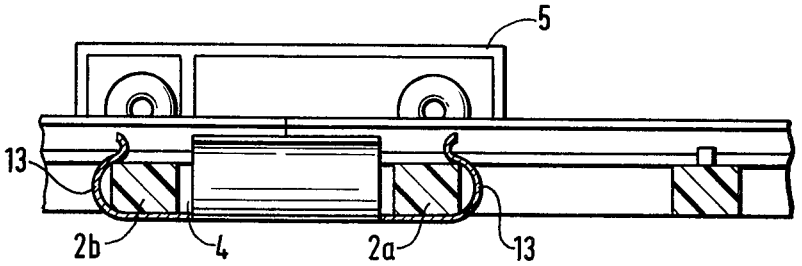

ELECTRICAL CONNECTING ELEMENT FOR A TOY RAILROAD

BACKGROUND OF THE INVENTION

The present invention relates to an electrical connecting element for current-conductive rails of a toy railroad which is supplied preferably by direct current. More particularly, it relates to an electrical connecting element which includes two contact members each contacting the respective rail and guided separately to one side of a rail track to form a two-pole connecting member electrically connectable with an electric current source.

An electrical connecting elements of the abovementioned general type are known in the art. In a known electrical connecting element two contact members are completely separated from each other. Each contact member is inserted in a gap between two ties which support the rails so that the upright end of the contact forms a lock with a plate of synthetic plastic material which carries the contact and abuts against the end faces of the ties. Since the connection location for the electric current source is provided at one side of the rail track, this requires that one contact member rests on the inner face of one rail and the other contact member rests on the outer face of the other rail. The complete separation of two contact members in the known electrical connecting element makes, on the one hand, mounting in two different gaps between the ties very difficult, and increases, on the other hand, the danger of short-circuiting as a result of displacement of one contact member on top of the other. Furthermore, because of the fact that one contact member rests against the inner face of one rail, the height of the wheel flange must not exceed a certain value in order to ensure running of the wheels over the contact member.

SUMMARY OF THE INVENTION

Accordingly, it is an object of the present invention to provide an electrical connecting element which avoids the disadvantages of the prior art.

In keeping with these objects and with others which will become apparent hereinafter, one feature of the present invention resides, briefly stated, in an electrical connecting element having a support member which carries a two-pole connecting member outside of the track and supports one contact member located above and the other contact member located below the support member, the support member being insertable between two adjacent ties.

When the electrical connecting element is constructed in accordance with the present invention, the contact members are separated from each other in a short-circuit-proof manner by the support member which carries two contact members. Furthermore, when the support member is inserted in the gap between two ties, both contact members are simultaneously set in place. In order to provide for electrical contact, the track is inserted from above into a receiver formed by the upright ends of the contact members so that the ends of the contact members rest on the outer faces of both rails. The lateral fixation of the support member is performed by both ends of the contacts, whereas the longitudinal fixation is performed by fitting of the support member into the gap between the ties.

In order to provide easily accessible connection at one side of the track, the support member, in accordance with another feature of the present invention, is T-shaped in the case of very small gauges, and its portion which extends laterally outwardly of the track parallel to the latter is also higher than the remainder portion. This laterally outward extending higher portion supports the two-pole connecting member.

As a rule, the ties are connected with each other by strips extending under the rails for reinforcement purposes. If it is desired to be able to arrange the connecting element at any point of the track, it is necessary in this case to form grooves in the support member for receiving the longitudinally extending strips. However, in the region in which two pieces of the track abut against one another the strips are omitted so that the inventive electrical connecting element can be inserted in this region without such grooves.

In accordance with still another feature of the present invention, the ends of the contact members resting on the outer faces of the rails may be turned upwardly and curved so as to form an undercut in which the rails can be clamped. In such a construction, a reliable electrical contact on the one hand, and firm connection between the connecting element and the track, on the other hand, are attained.

A further feature of the present invention is that the two-pole connecting member for the current source may be formed by tubular rivets which are suitable for insertion of plug pins and connected to the respective contact member. The contact members can be mounted on the support member by contact sockets formed by the tubular rivets. It is advantageous, however, to cage the contact member's additionally by the strips which can be bent inwardly by ultrasonic welding when the support member is constituted of synthetic plastic material.

Finally, in accordance with still a further embodiment of the present invention, the contact member located on the lower surface of the support member has two opposite laterally projecting tongues which extend between the rails and have end portions which are bent so as to grip the end ties of two adjacent portions of the track. In such a construction provided for supporting purposes, when the connecting element is inserted in the region of joining of the portions of the track, an additional connection of the pieces of the track is attained. This connection is otherwise effected only by the rail connectors used for the electrical and mechanical connection of one line of rails in each case.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a plan view of an electrical connecting element mounted in a toy railroad, in accordance with the present invention;

FIG. 2 is a view showing a section taken along the line I—I of FIG. 1.

DESCRIPTION OF THE PREFERRED EMBODIMENTS

An electrical connecting element in accordance with the present invention is identified by reference numeral 3. It is inserted at a point 1 between two portions of a track formed by two rails *7a* and *7b*. The electrical connecting element 3 is arranged between two end ties *2a* and *2b* of these portions of the track and consists of a supporting member 4 which is constituted of synthetic plastic material and has an extension portion 5 at its one side and thereby is T-shaped. The electrical connecting element 3 and particularly its portion 5 extends laterally outwardly beyond the track or more particularly beyond the rail *7a*.

The portion 5 is provided with two-pole connecting member formed by two tubular rivets 6. In order to mount the tubular rivets 6 at the end face of the support member 4, its portion 5 has a height which is increased in a step-like manner relative to the remainder portion of the same. A contact member 8 located on the outer face of the rail *7a* adjacent to the connection is arranged at the upper side of that portion of the support member 4 which is located laterally outwardly of the track. The contact member 8 is connected with one pole of the connection by a tab 9 which is provided at the side and rests against the inner face of the portion 5 of the T-shaped support member 4. A contact member 10 located on the outer face of the other rail *7b* is mounted at the lower side of the support member 4 and is similarly connected with the other pole by a tab 11 which is provided at the side and rests against the inner face of the portion 5 of the T-shaped support member 4.

The ends of both contact members 8 and 10 are raised and so bent that they form an undercut in which the portions of the track can be clamped. The mounting of the contact members on the support member is performed, on the one hand, by the tubular rivets 6 and, on the other hand, by embedding of the contact members in respective grooves of the support member. Ridge-like raised portions 12 of the edges of receiving regions are bent inwardly for holding of the contact members, by means of ultra-sonic welding.

In order to improve the mechanical connection of both portions of the track, the contact member 10 arranged at the lower side of the support member 4 is provided with two opposite tongues 13 which extend laterally and between the rails *7a* and *7b*. The ends of the tongues 13 are raised to form clamps for gripping the end ties *2a* and *2b* of both track portions which abut against each other. When the electrical connecting element 3 is inserted between the rails *7a* and *7b* and the ties *2a* and *2b*, the drive current is supplied via plug pins 14 which are pushed into the tubular rivets 6.

It will be understood that each of the elements described above, or two or more together, may also find a useful application in other types of constructions differing from the types described above.

While the invention has been illustrated and described as embodied in an electrical connecting element for a toy railroad, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An electrical connecting element for a track of a toy railroad, including current-conductive rails which rest upon ties of insulating material and each have two rail portions joined with one another at a predetermined location, the electrical connecting element comprising a support member insertable between two adjacent ties in the region of the location of joining of the rail portions and extending laterally outwardly of the track at one side of the latter; two-pole connecting member formed at the one side of the track and arranged to be electrically connected with an electric current source, said two-pole connecting member being supported on said support member; and two electrical contact members each arranged to electrically contact a respective one of the rails and guided to said one side of the track so as to form there said two-pole connecting member, said contact members being also supported on said support member so that one of said contact members contacts with a laterally outer face of the rail which is closer to said two-pole connecting member, whereas the other of said contact members electrically contacts with a laterally outer face of the rail which is further from said two-pole connecting member, each of said contact members being provided with clamping means arranged so that when the rail portions are placed onto the electrical connecting element from above, they are clamped by said contact members, and said other contact member being provided with gripping means arranged so that said other contact member grips two ties located adjacent to the joined rail portions of the rail at the opposite side of said location.

2. An electrical connecting element as defined in claim 1, wherein each of said contact members has an end portion which is bent upwardly and curved in such a manner that said end portions together form an undercut in which the rail portions can be inserted and clamped so as to form said clamping means.

3. An electrical connecting element as defined in claim 1, wherein said two-pole connecting member includes two tubular rivets each electrically connected with the respective contact and arranged to receive plug pins.

4. An electrical connecting element as defined in claim 1, wherein said other contact member has two tongues spaced from one another in the direction of elongation of the rails and extending between the latter, said tongues having end sections which are curved to at least partially surround the two ties located adjacent to the joined rail portions of the rails at the opposite sides of said location and to grip the two ties so as to form said gripping means.

5. An electrical connecting element as defined in claim 1, wherein said support element is T-shaped and has a longitudinal portion extending in the direction of elongation of the rails, and a transverse portion extending in the direction which is transverse to the direction of elongation of the rails said two-pole connecting member being supported by said transverse portion whereas said contact members are supported by said longitudinal portion of said support element.

6. An electrical connecting element as defined in claim 5, wherein said transverse portion of said support element which supports said two-pole connecting element has a height exceeding that of said longitudinal portion thereof.

* * * * *